US011176875B2

(12) United States Patent
Sohn et al.

(10) Patent No.: US 11,176,875 B2
(45) Date of Patent: Nov. 16, 2021

(54) DISPLAY APPARATUS AND OPERATING METHOD THEREOF

(71) Applicant: SAMSUNG ELECTRONICS CO., LTD., Suwon-si (KR)

(72) Inventors: Hosik Sohn, Suwon-si (KR); Jinmo Kang, Suwon-si (KR); Seungjin Baek, Suwon-si (KR); Hoyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/066,987

(22) Filed: Oct. 9, 2020

(65) Prior Publication Data

US 2021/0125545 A1 Apr. 29, 2021

(30) Foreign Application Priority Data

Oct. 25, 2019 (KR) ..... 10-2019-0134114

(51) Int. Cl.
*G09G 3/32* (2016.01)

(52) U.S. Cl.
CPC ..... *G09G 3/32* (2013.01); *G09G 2320/0276* (2013.01); *G09G 2320/0673* (2013.01); *G09G 2320/0693* (2013.01)

(58) Field of Classification Search
CPC ..... G09G 3/32; G09G 2320/0693; G09G 2320/0673; G09G 2320/0276
See application file for complete search history.

(56) References Cited

U.S. PATENT DOCUMENTS

| | | | | |
|---|---|---|---|---|
| 7,027,015 | B2 | 4/2006 | Booth, Jr. et al. | |
| 8,111,222 | B2 | 2/2012 | Johnson et al. | |
| 2006/0214940 | A1 | 9/2006 | Kinoshita et al. | |
| 2007/0052735 | A1* | 3/2007 | Chou | G09G 3/2003 345/690 |

(Continued)

FOREIGN PATENT DOCUMENTS

| | | | |
|---|---|---|---|
| EP | 3 664 069 | A1 | 6/2020 |
| KR | 10-2005-0085039 | A | 8/2005 |

(Continued)

OTHER PUBLICATIONS

International Search Report (PCT/ISA/210) and Written Opinion (PCT/ISA/237) dated Jan. 20, 2021 issued by the International Searching Authority in International Application No. PCT/KR2020/013544.

*Primary Examiner* — Muhammad N Edun
(74) *Attorney, Agent, or Firm* — Sughrue Mion, PLLC

(57) ABSTRACT

A display apparatus includes a display panel including a light-emitting device; a storage storing a target gamma value and a calibration matrix; a processor configured to obtain first modulation data from input data and calibrate the first modulation data via the calibration matrix, obtain second modulation data from the calibrated first modulation data, and generate a driving signal from the second modulation data; and a panel driver configured to drive the display panel by applying the driving signal to the light-emitting device, wherein the calibration matrix has a compensation coefficient for making a gamma curve corresponding to the driving signal to be the same as a target gamma curve corresponding to the target gamma value.

19 Claims, 11 Drawing Sheets

(56) References Cited

U.S. PATENT DOCUMENTS

| | | | | |
|---|---|---|---|---|
| 2007/0132683 | A1* | 6/2007 | Kong | G09G 3/2092 345/87 |
| 2009/0034868 | A1* | 2/2009 | Rempel | G09G 3/3426 382/264 |
| 2010/0265266 | A1* | 10/2010 | Liu | G09G 5/02 345/600 |
| 2011/0316893 | A1 | 12/2011 | Lee et al. | |
| 2014/0146090 | A1 | 5/2014 | Oh et al. | |
| 2018/0040295 | A1* | 2/2018 | Deng | G09G 5/10 |
| 2018/0182298 | A1* | 6/2018 | Jang | G09G 3/3258 |

FOREIGN PATENT DOCUMENTS

| | | | |
|---|---|---|---|
| KR | 10-1093265 | B1 | 12/2011 |
| KR | 10-2015-0078850 | A | 7/2015 |
| WO | 2019/054674 | A1 | 3/2019 |

* cited by examiner

DISPLAY APPARATUS AND OPERATING METHOD THEREOF

CROSS-REFERENCE TO RELATED APPLICATION

This application is based on and claims priority under 35 U.S.C. § 119 to Korean Patent Application No. 10-2019-0134114, filed on Oct. 25, 2019, in the Korean Intellectual Property Office, the disclosure of which is incorporated by reference herein in its entirety.

BACKGROUND

1. Field

The disclosure relates to a display apparatus and an operating method thereof, and more particularly, to a display apparatus having improved uniformity among light-emitting devices included in the display apparatus, and an operating method of the display apparatus.

2. Description of Related Art

A light-emitting diode (LED) is a semiconductor light-emitting device which transforms electric energy into light energy. An LED display apparatus is a device which is driven by currents and has a brightness varying according to magnitudes of the currents.

The LED display apparatus may be embodied by using micro LEDs (μLEDs). A micro LED is an ultra-small LED having one tenth of a length and one hundredth of an area of a normal LED chip, for example, having a size of about 10 to about 100 micrometers (μm). The micro LED has a higher response speed and lower power consumption and provides greater brightness than a normal LED. Also, when the micro LED is applied to a display and is bent, the micro LED is not broken.

A micro LED display panel is one of flat display panels and includes a plurality of inorganic LEDs each having a size equal to or less than 100 μm. Compared to a liquid crystal display (LCD) panel requiring a backlight, the micro LED display panel provides a better contrast, a higher response rate, and greater energy efficiency. Both an organic LED (OLED), and a micro LED which is an inorganic light-emitting device, have excellent energy efficiency. However, the micro LED has better emission efficiency and a greater life span than the OLED.

An EPI layer (Epitaxial wafer) is deposited on a wafer to form an LED. To embody a display by using the LED, chips on the wafer are cut one by one, and then, LEDs are taken by a stamp and transferred to a module. The LEDs transferred to the module are combined to form an LED display panel. In this case, due to differences in various processes, such as a varying temperature of the wafer or an irregular thickness of the layer, the chips may have different characteristics from each other. That is, the chips may have a color difference according to a deviation in a wavelength or a different brightness value according to an input current.

To calibrate the difference of characteristics between devices, chips that are cut may be tested one by one with respect to electricity, and LEDs may be classified into groups based on characteristics, according to a brightness or a wavelength. Then, the LEDs having similar characteristics may be gathered and used together. However, in the case of the micro LED, the size is too small as described above, and thus, it is difficult not only to cut the chips, but also to perform electrical tests on the chips that are cut. Also, even when the devices are classified into groups based on similar characteristics via electrical tests, when currents are applied to the devices classified into the same group, the devices may still have different characteristics. Thus, it is required to uniformly calibrate the different characteristics of each LED.

SUMMARY

In accordance with an aspect of the disclosure, a display apparatus includes a display panel including a light-emitting device; a storage storing a target gamma value and a calibration matrix; a processor configured to obtain first modulation data from input data and calibrate the first modulation data via the calibration matrix, obtain second modulation data from the calibrated first modulation data, and generate a driving signal from the second modulation data; and a panel driver configured to drive the display panel by applying the driving signal to the light-emitting device, wherein the calibration matrix includes a compensation coefficient for making a gamma curve corresponding to the driving signal to be the same as a target gamma curve corresponding to the target gamma value.

The storage stores a respective calibration matrix for each pixel including the light emitting device, and wherein the processor is further configured to calibrate the first modulation data by using the respective calibration matrix for each pixel from among the plurality of pixels.

The storage may store a first gamma look-up table and a second gamma look-up table, and the processor may be further configured to obtain the first modulation data from the input data according to the first gamma look-up table and obtain the second modulation data from the calibrated first modulation data according to the second gamma look-up table.

The first gamma look-up table may include a first value calculated by applying a standard gamma value to a first input value, and the second gamma look-up table may include a second value calculated by applying a reciprocal number of the standard gamma value to a second input value.

When the gamma curve corresponding to the driving signal is the same as the target gamma curve corresponding to the target gamma value, the compensation coefficient may have a value of 1.

In accordance with an aspect of the disclosure, an apparatus for generating a calibration matrix includes a measurer configured to measure an output value of a light-emitting device; and a matrix generator configured to predict a gamma value of the light-emitting device from the measured output value, generate a compensation coefficient for compensating for a difference between the predicted gamma value and a target gamma value, and generate the calibration matrix from the compensation coefficient.

When the difference between the predicted gamma value and the target gamma value is greater than or equal to a reference value, the matrix generator may be further configured to predict an average gamma value of a plurality of other light-emitting devices which were located apart from the light-emitting device by a distance that is less than or equal to a predetermined distance on a wafer where the light-emitting device was located, generate a second compensation coefficient for compensating for the difference between the predicted average gamma value and the target gamma value, and generate the calibration matrix from the second compensation coefficient.

The matrix generator may be further configured to predict the gamma value from two or more output values measured in response to two or more input gradations applied as input signals to the light-emitting device.

The two or more input gradations may include a low gradation less than a predetermined gradation and a high gradation greater than the predetermined gradation.

In accordance with an aspect of the disclosure, a display method includes obtaining first modulation data from input data of a light-emitting device; calibrating the first modulation data; obtaining second modulation data from the calibrated first modulation data; generating a driving signal from the second modulation data; and driving a display panel by applying the driving signal to the light-emitting device, wherein the calibrating of the first modulation data includes calibrating the first modulation data by using a calibration matrix comprising a compensation coefficient for making a gamma curve corresponding to the driving signal to be the same as a target gamma curve corresponding to a target gamma value.

The calibrating of the first modulation data may include calibrating the first modulation data by using a respective calibration matrix for each pixel including the light-emitting device.

The first modulation data may be obtained by modulating the input data according to a first gamma look-up table, and the second modulation data may be obtained by modulating the calibrated first modulation data according to a second gamma look-up table.

The first gamma look-up table may include a first value calculated by applying a standard gamma value to a first input value, and the second gamma look-up table may include a value calculated by applying a reciprocal number of the standard gamma value to an input value.

When the gamma curve corresponding to the driving signal is the same as the target gamma curve corresponding to the target gamma value, the compensation coefficient may have a value of 1.

In accordance with an aspect of the disclosure, a method of generating a calibration matrix includes measuring an output value corresponding to an input gradation of a light-emitting device; predicting a gamma value of the light-emitting device from the measured output value; obtaining a compensation coefficient for compensating for a difference between the predicted gamma value and a target gamma value; and generating the calibration matrix from the compensation coefficient.

The method may further include, when the difference between the predicted gamma value and the target gamma value is greater than or equal to a reference value, predicting an average gamma value of a plurality of other light-emitting devices which were located apart from the light-emitting device by a distance that is less than or equal to a predetermined distance on a wafer where the light-emitting device was located, wherein the method may further include generating a second calibration matrix including a second compensation coefficient for compensating for the difference between the predicted average gamma value and the target gamma value, by using the predicted average gamma value rather than the predicted gamma value.

The measuring of the output value may include measuring at least two output values corresponding to at least two input gradations, and the predicting of the gamma value may include predicting the gamma value from the at least two output values measured in correspondence to the at least two input gradations.

In accordance with an aspect of the disclosure, a computer-readable recording medium having recorded thereon a program for executing a display method on a computer includes obtaining first modulation data from input data of a light-emitting device; calibrating the first modulation data; obtaining second modulation data from the calibrated first modulation data; generating a driving signal from the second modulation data; and driving a display panel by applying the driving signal to the light-emitting device, wherein the calibrating of the first modulation data includes calibrating the first modulation data by using a calibration matrix comprising a calibration coefficient for making a gamma curve corresponding to the driving signal to be the same as a target gamma curve corresponding to a target gamma value.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
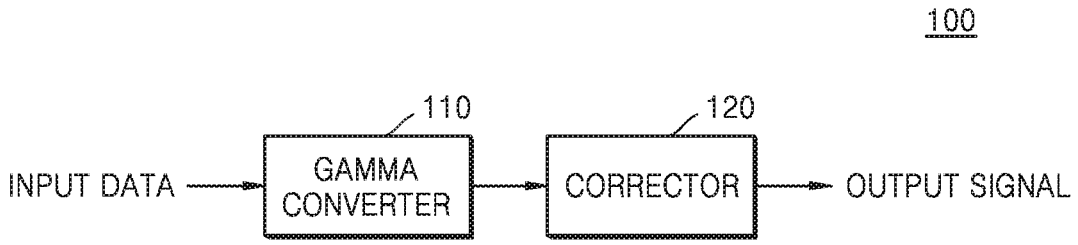
FIG. 1 is a diagram for describing an operation, performed by a display apparatus, of correcting data to reproduce an image on a screen.

Hereinafter, embodiments will be described in detail with reference to the accompanying drawings so that one of ordinary skill in the art can easily execute the disclosure. However, the disclosure may have different forms and should not be construed as being limited to the embodiments described herein.

Terms used in the disclosure are selected from among common terms that are currently widely used in consideration of their function in the disclosure. However, the terms may be different according to an intention of one of ordinary skill in the art, a precedent, or the advent of new technology.

Therefore, the terms used in the disclosure are not merely designations of the terms, but the terms are defined based on the meaning of the terms and content throughout the disclosure.

Also, the terms used in the disclosure are merely used to describe one or more embodiments and do not intend to limit the disclosure.

Throughout the specification, when a part is referred to as being "connected" to other parts, the part may be "directly connected" to the other parts or may be "electrically connected" to the other parts with other devices therebetween.

The term "the" and similar demonstratives that are used in this specification, in particular in the claims, may refer to both a singular form and a plural form. Also, unless there is a description clearly defining an order of operations of a method according to the disclosure, the operations may be performed in appropriate orders. The disclosure is not limited to a described order of the operations.

The expression "in some embodiments of the disclosure" or "according to an embodiment of the disclosure" used in this specification does not necessarily refer to the same embodiments of the disclosure.

Throughout the disclosure, the expression "at least one of a, b or c" indicates only a, only b, only c, both a and b, both a and c, both b and c, all of a, b, and c, or variations thereof.

The embodiments of the disclosure may be indicated as functional block components and various processing operations. The functional blocks may be implemented as various numbers of hardware and/or software components performing specific functions. For example, the functional blocks of the disclosure may be implemented by one or more microprocessors or by circuit configurations for certain functions. Also, for example, the functional blocks of the disclosure may be implemented by various programming or scripting languages. The functional blocks may be implemented as algorithms executed by one or more processors. Also, the disclosure may adopt the related art for setting of electronic environments, processing of signals, and/or processing of data. The terms "mechanisms," "elements," and "devices" may be broadly used and may not be limited to mechanical and physical components.

Also, connecting lines or connecting members between components illustrated in the drawings are examples of functional connection and/or physical or circuital connection. In an actual device, components may be connected via various functional connections, physical connections, and circuital connections which are to be replaced or to be added.

The terms described in the specification, such as "unit," "module," etc., denote a unit processing at least one function or operation, which may be implemented as hardware or software or a combination thereof.

According to one or more embodiments, the term "user" may denote a producer, a manufacturer, or a tester of a display apparatus, a manager or an installation technician controlling functions or operations of the display apparatus, or a general viewer using the display apparatus.

Hereinafter, the disclosure will be described in detail by referring to the accompanying drawings.

FIG. 1 is a diagram for describing an operation, performed by a display apparatus 100, of correcting data to reproduce an image on a screen. The display apparatus 100 is required to display and reproduce an original image on a screen by using an intrinsic RGB color space.

However, light-emitting devices included in the display apparatus 100 may have characteristics that are not the same as one another for various reasons. For example, when forming light-emitting diodes (LED) devices, the LEDs may have different brightnesses and different colors from one another due to dispersion in various processes. Also, a device, which is driven by a current, such as an LED, has brightness that varies according to a current. However, the brightness and a color of an output signal may also be changed due to an intrinsic resistance of the LED, etc.

In order to correct differences among the light-emitting devices, the display apparatus 100 may perform gamma correction such that a brightness curve corresponding to a gradation value of input data matches with a specific gamma curve. Thereafter, the display apparatus 100 may restore an original image by additionally performing chromaticity or brightness correction on a signal which is gamma-corrected.

Referring to FIG. 1, the display apparatus 100 may include a gamma converter 110 and a corrector 120.

The gamma converter 110 may perform gamma correction on input data. The corrector 120 may correct the data that is gamma-corrected. The corrector 120 may correct a color and/or a brightness of the data that is gamma-corrected, by applying a color correction matrix.

The display apparatus 100 may obtain an output signal from the corrected data and apply a driving signal corresponding to the output signal to each of light-emitting devices included in the display apparatus 100, so that the light-emitting devices may output signals having a uniform brightness and color.

After the display apparatus 100 applies the gamma value to the input data, the display apparatus 100 may correct the brightness and the color of the data, to which the gamma value is applied.

However, in some cases, an LED display apparatus or a micro LED display apparatus may perform color correction first, and then, may perform gamma correction. In this case, the gamma correction is performed on a signal which is already color-corrected. Thus, the color correction may not be performed again on the signal which is gamma-corrected.

Figure 2:
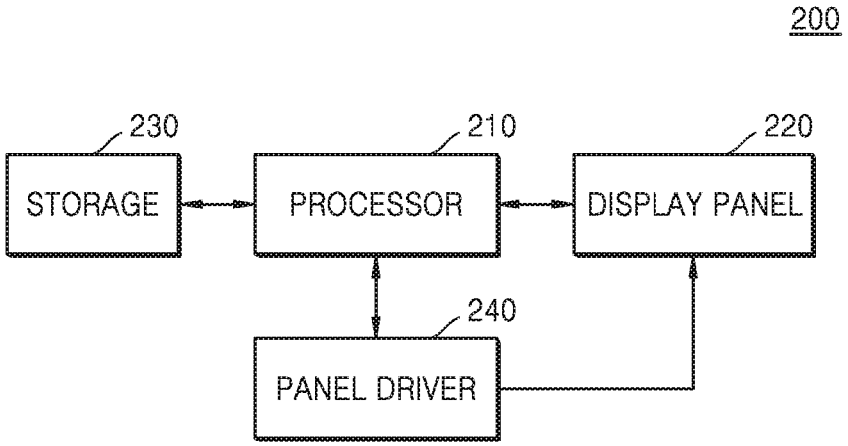
FIG. 2 is a block diagram of an internal structure of a display apparatus according to an embodiment.

FIG. 2 is a block diagram of an internal structure of a display apparatus 200 according to an embodiment.

Referring to FIG. 2, the display apparatus 200 may include a processor 210, a display panel 220, a storage 230, and a panel driver 240.

The display apparatus 200 may be realized as a digital television (TV), a three-dimensional (3D) TV, a smart TV, an LED TV, etc., and may include not only a flat display apparatus, but also a curved display apparatus having a screen having a curvature or a flexible display apparatus having an adjustable curvature. An output resolution of the display panel 220 may correspond to high definition (HD), full HD, ultra HD, 8K ultra HD, or a resolution for achieving a more vivid output image than 8K ultra HD.

According to an embodiment, the display panel 220 may include a self-emitting-type display panel using an LED, which is an inorganic light-emitting device. The display panel 220 may include a self-emitting-type display panel using a micro LED.

A thin-film transistor (TFT) constituting a TFT layer (or a backplane) for driving a self-emitting light source may not be limited to a particular structure or type. That is, according to an embodiment, the TFT may also be realized as an oxide TFT, a Si TFT (poly silicon, a-silicon), an organic TFT, a graphene TFT, or the like, in addition to an LTPS TFT. Also, only a p-type (or n-type) MOSFET may be manufactured in a Si wafer CMOS process and applied as the TFT.

The display panel 220 which is the self-emitting-type and uses the LED may include a set of a plurality of cabinets. Each cabinet may include a set of a plurality of modules.

Also, each module may include a plurality of pixels arranged in the form of a matrix. For example, when the display apparatus 200 corresponds to a television (TV) including a micro LED module having a resolution of 480×270, each module may include 480×270 micro LED pixels. One pixel may include at least three light-emitting devices, namely, a red LED, a green LED, and a blue LED. Thus, one module may include at least the total 388,800 light-emitting devices that are arranged.

According to an embodiment, the display panel 220 may be implemented, as an individual device, in a wearable device, a portable device, a handheld device, and various other electronic products or devices, for which displays are required. Also, the display panel 220 may be applied to a display apparatus, such as a personal computer (PC) monitor, a high-resolution TV and signage, an electronic display, etc. in the form of a matrix through a plurality of assembled pieces.

The panel driver 240 may drive the display panel 220 under control of the processor 210. The panel driver 240 may drive the entire display panel 220 or drive the display panel 220 in the unit of a cabinet, which is included in the display panel, in the unit of a module, which is included in the cabinet, in the unit of a pixel, which is included in the module, or in the unit of a light-emitting device, which is included in the pixel. The panel driver 240 may supply a driving signal to the display panel 220 according to each driving unit. The driving signal may include a driving voltage or a driving current.

The light-emitting devices included in the display panel 220 may have different gamma characteristics. To correct the different gamma characteristics, the light-emitting devices included in the display panel 220 may be gamma-corrected in advance by a certain gamma value. The standard gamma value which is set according to the sRGB standards and the national television system committee (NTSC) is 2.2, and thus, according to an embodiment, the light-emitting devices included in the display panel 220 may also be corrected to the standard gamma value, which is 2.2.

The gamma correction may denote conversion of gamma characteristics such that the gamma characteristics of data correspond to a certain gamma value. That is, the gamma correction may denote adjusting of a signal value of light-emitting devices such that brightness characteristics of data have characteristics of a desired gamma curve.

To perform the gamma correction, an apparatus for generating a calibration matrix may capture the output of light-emitting devices of the same color included in a certain number of pixels, for example, dozens of pixels, included in the display panel 220, by using a measurer, and may adjust voltages or currents applied to the light-emitting devices when certain data is input, so that the light-emitting devices may have specific brightnesses. According to an embodiment, the gamma correction may be performed by a user producing or manufacturing the display apparatus 200 or by an external apparatus performing the function of producing or manufacturing the display apparatus 200.

The storage 230 may store various data required for an operation of the display apparatus 200 and programs for a processing and controlling operation of the processor 210. The storage 230 may store at least one instruction executable by the processor 210. According to an embodiment, the at least one instruction stored in the storage 230 may include an instruction to generate an output signal by using a respective calibration matrix generated for each pixel.

The storage 230 may be realized as internal memories included in the processor 210, such as read-only memory (ROM), random-access memory (RAM), etc., or may be realized as a separate memory outside the processor 210. When the storage 230 is realized as a separate memory outside the processor 210, the storage 230 may be realized as a memory embedded in the display apparatus 200 or a memory detachable from the display apparatus 200.

The processor 210 may control general operations of the display apparatus 200. The processor 210 may execute functions of the display apparatus 200 by executing the at least one instruction stored in the storage 230. FIG. 2 illustrates one processor 210. However, the display apparatus 200 may further include a plurality of processors. In this case, according to an embodiment, each of operations performed by the display apparatus 200 may be executed by at least one of the plurality of processors.

According to an embodiment, unlike the display apparatus 100 of FIG. 1, the display apparatus 200 of FIG. 2 may perform gamma correction on a signal which is already color-corrected. When the gamma correction is performed after the color correction, a color or a brightness of a signal on which the gamma correction is performed may not be additionally corrected. To solve this problem, the display apparatus 200 of FIG. 2 may use a first gamma look-up table and a second gamma look-up table.

According to an embodiment, the first gamma look-up table and the second gamma look-up table may be stored in the storage 230.

The processor 210 may obtain first modulation data from input data by using the first gamma look-up table stored in the storage 230. The first gamma look-up table may be used to modulate a data signal by using a virtual gamma value. The virtual gamma value may be 2.2, which is the standard gamma value.

According to an embodiment, the processor 210 may calibrate the first modulation data by using a calibration matrix. To calibrate data by using the calibration matrix may denote a process performed by the display apparatus 200 to minimize a difference of colors and/or brightnesses between pixels. In this case, minimizing the difference of colors and/or brightnesses between the pixels may include allowing a color of each pixel to have an output color in compliance with the standards of an RGB color space and making brightness characteristics of each pixel the same as characteristics of the standard gamma value.

A brightness of each LED may be different from the standard gamma value. The LED may have a wavelength difference caused by a temperature difference between wafers or layers in a manufacturing process. Thus, each LED may output a different color, or the LED may have a process distribution, due to a difference in the quality of layers or the thickness of the wafers. Also, the brightness of each light-emitting device may not be the same as the standard gamma value due to various reasons, such as changes in the brightness of an LED display due to heating states of LED modules, or gamma correction performed by measuring a plurality of light-emitting devices of the same color included in a plurality of pixels altogether.

Also, the LED has a brightness that varies according to a current, and the brightness and the color of the LED may also be changed due to the intrinsic characteristics of the LED. Because each LED has a unique resistance value, for each color, a brightness change based on a current change may become different between the LEDs, even when the same current and the same voltage are applied to the LEDs. Also, a color coordinate of each LED is changed in a different way according to an increase in the current, so that each LED has different color shift characteristics from each other. For example, when the LED is a red LED or a blue LED, x and y coordinates of the tristimulus values may maintain approximately constant values according to an increase in the current. However, when the LED is a green LED, x and y coordinates of the tristimulus values may be significantly changed according to an increase in the current.

Thus, it is required to perform correction such that the LEDs have a uniform color and a uniform brightness change, by taking into account brightness change characteristics (i.e., a gamma curve) and color characteristics of each LED according to a current.

According to an embodiment, the display apparatus 200 may use the calibration matrix to calibrate the brightness change characteristics and/or the color characteristics of each of the pixels. The processor 210 may obtain the calibration matrix stored for each pixel and calibrate first modulation data with respect to each of the plurality of light-emitting devices included in the pixels by using the calibration matrix.

After obtaining the first modulation data, the processor 210 may calibrate the first modulation data by using the calibration matrix and may modulate the calibrated value again according to the second gamma look-up table to obtain second modulation data. The second gamma look-up table may be used to modulate a data signal by using a virtual gamma value, like the first gamma look-up table. The virtual gamma value used in the second gamma look-up table may be 1/2.2, which is a reciprocal value of the standard gamma value.

The processor 210 may apply an analog gamma value to the second modulation data that has been obtained according to the second gamma look-up table. An analog gamma may be a physical gamma for adjusting a signal via a voltage, unlike the virtual gamma used by first gamma look-up table or the second gamma look-up table. The processor 210 may apply the analog gamma to the second modulation data to change the second modulation data to a driving signal, such as a voltage or a current, which may be applied to a driving device.

The processor 210 may control the panel driver 240 such that the panel driver 240 applies the driving signal to a corresponding light-emitting device included in the display panel 220. The panel driver 240 may apply the driving signal to the light-emitting device so that the light-emitting device may emit light.

Preferably, the analog gamma value may be 2.2, which is the standard gamma value. In this case, the second gamma look-up table used by the processor 210 and the analog gamma value may be offset by each other. The second gamma look-up table applies 1/2.2, which is a reciprocal number of the target gamma value, to an input signal. Thus, when the analog gamma value is 2.2, the second gamma look-up table and the analog gamma value may be connected in series and offset by each other. As a result, the same result may be obtained as when the processor 210 applies the gamma value to the input data by using the first gamma look-up table and corrects data by applying the calibration matrix to a signal to which the gamma value is applied. Through this operation, the display apparatus 200 of FIG. 2 may have a result which is the same as a result obtained by correcting a signal which is already gamma-corrected, like the display apparatus 100 of FIG. 1.

However, as described above, even when the plurality of light-emitting devices included in the display panel 220 are gamma-corrected to the standard gamma value, the analog gamma value applied to each light-emitting device may be different from the standard gamma value, which is 2.2. In other words, the gamma correction is not performed for each light-emitting device individually, and thus, correction is not performed by reflecting the brightness characteristics of each individual light-emitting device. Thus, even when the light-emitting devices included in the pixels are gamma-corrected altogether, gamma deviations may occur among the light-emitting devices, because the light-emitting devices have different brightness characteristics. When the analog gamma value is not 2.2, the second gamma look-up table and the analog gamma value may not be offset by each other. Thus, the driving signal may cause the light-emitting device to emit light via the characteristics of a gamma value that is different from a desired target gamma value.

According to an embodiment, the gamma value indicating the brightness characteristics to be realized by the display apparatus 200 will be referred to as a target gamma value. The target gamma value is a target brightness value to be represented by the display apparatus 200, which may correspond to the standard gamma value 2.2.

According to an embodiment, when the processor 210 corrects the first modulation data, the processor 210 may correct the first modulation data by using the calibration matrix having compensation coefficients, the calibration matrix being generated for each pixel. The calibration matrix may include the compensation coefficient for each light-emitting device included in the pixel.

To this end, according to an embodiment of the disclosure, an external apparatus may measure a brightness of each light-emitting device by using a measurer. An analog gamma value of the light-emitting device may be predicted from the brightness measured by the external apparatus. The external apparatus may calculate the compensation coefficient for each of a red LED, a green LED, and a blue LED included in a pixel by using the predicted analog gamma value and may generate the calibration matrix having the calculated compensation coefficients for each pixel. A process in which the external apparatus generates the calibration matrix will be described with reference to FIG. 6.

According to an embodiment, the calibration matrix may be a matrix configured to make the change characteristics (i.e., gamma curve) of a driving signal applied to the display panel 220 to be the same as the characteristics (i.e., target gamma curve) according to the target gamma value. According to an embodiment, the calibration matrix may have the compensation coefficients for compensating for the change characteristics about the driving signal with respect to each light-emitting device by the characteristics according to the target gamma value.

The calibration matrix generated by the external apparatus may be stored in the storage 230. The storage 230 may store the target gamma value and the calibration matrix for each pixel.

According to an embodiment, the processor 210 may calibrate the obtained first modulation data by using the calibration matrix having the compensation coefficients, the calibration matrix being obtained from the storage 230. The processor 210 may obtain second modulation data according to the second gamma look-up table, from the calibrated first modulation data, and change the second modulation data into a driving signal according to the analog gamma value. The panel driver 240 may apply the driving signal to the light-emitting device.

According to an embodiment, the driving signal may be generated via calibration through the calibration matrix having the compensation coefficients, and thus, may compensate for a difference between the standard gamma value and the analog gamma value. Thus, the change characteristics of the driving signal may have the change characteristics according to the target gamma value. That is, even when the analog gamma value of a particular light-emitting device is different from the standard gamma value, the change characteristics of the light-emitting device may become the same as the light-emitting characteristics of a light-emitting device having the standard gamma value. Thus, uniformity among the light-emitting devices may be obtained.

Figure 3:
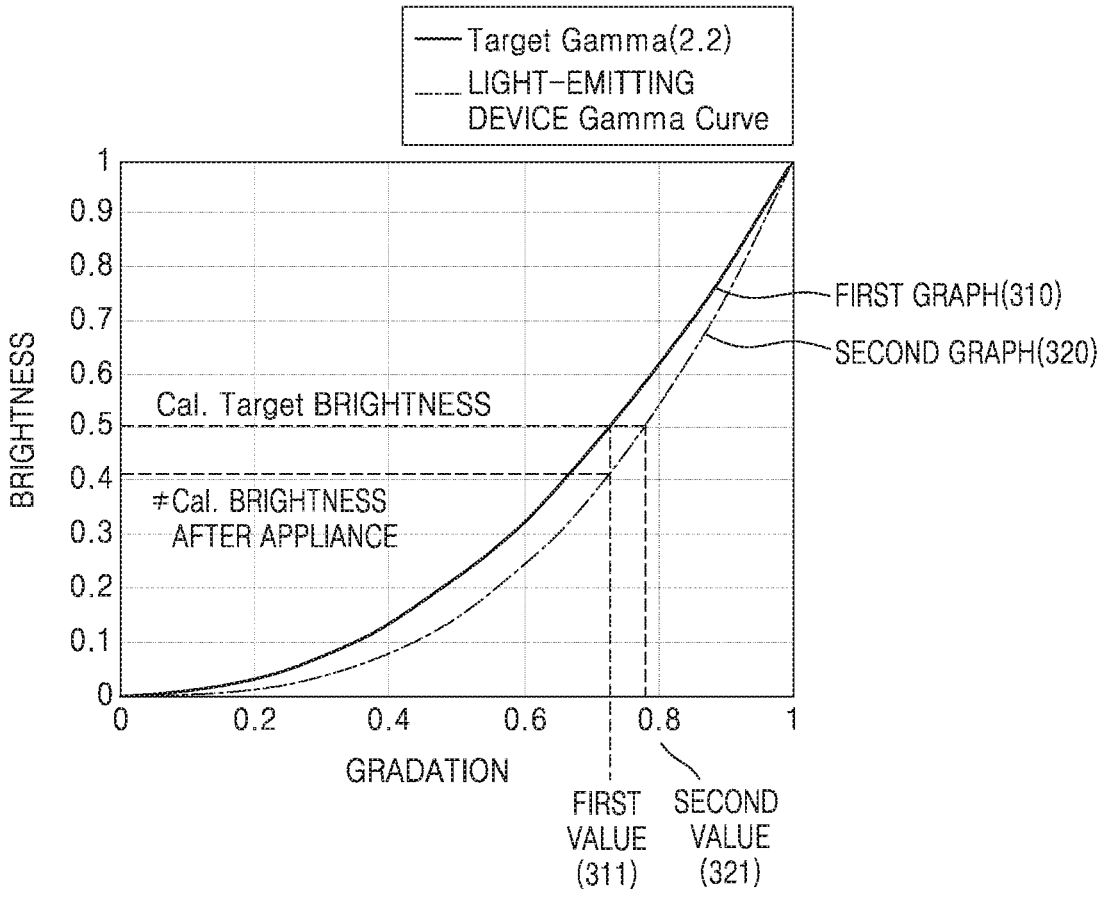
FIG. 3 shows a graph illustrating a case in which an analog gamma curve of a light-emitting device and a standard gamma curve are different from each other, according to an embodiment.

FIG. 3 shows a graph illustrating a case in which an analog gamma curve of a light-emitting device and a standard gamma curve are different from each other, according to an embodiment. Referring to FIG. 3, a horizontal axis of the graph indicates gradation levels in which the maximum value is normalized as 1 and a vertical axis of the graph indicates brightness levels in which the maximum value is normalized as 1, wherein the brightness levels correspond to the gradation levels, respectively.

In FIG. 3, a first graph 310 illustrates a case in which a gamma value of a light-emitting device corresponds to the target gamma value, that is, the case in which the gamma value of the light-emitting device is 2.2, which is the standard gamma value.

A second graph 320 illustrates an example of an actual gamma value of a light-emitting device. In FIG. 3, it is assumed that the actual gamma value of the light-emitting device does not correspond to the target gamma value.

In the first graph 310, when an input gradation of the light-emitting device corresponds to a first value 311, a brightness of the light-emitting device may correspond to 0.5. However, in the second graph 320 illustrating a case in which the gamma value of the light-emitting device is different from the standard gamma value, when the input gradation corresponds to the first value 311, the brightness of the light-emitting device may correspond to a value that is less than 0.5. That is, in order that a light-emitting device, the gamma value of which is not 2.2, outputs the brightness of 0.5, a second value 321, which is different from the first value 311, may have to be applied as the input gradation.

As described above, according to an embodiment, when the analog gamma value of each light-emitting device is different from the standard gamma value, 2.2, the calibration matrix having the compensation coefficients for compensating for the difference between the analog gamma value and the standard gamma value may be generated.

According to an embodiment, the processor 210 may correct a signal of each light-emitting device by using the calibration matrix which is generated based on the gamma characteristics of each individual light-emitting device. Thus, even when the gamma value of the light-emitting device is not the same as the standard gamma value, output characteristics of the light-emitting device may have a gamma curve which is substantially the same as the first graph 310.

Figure 4:
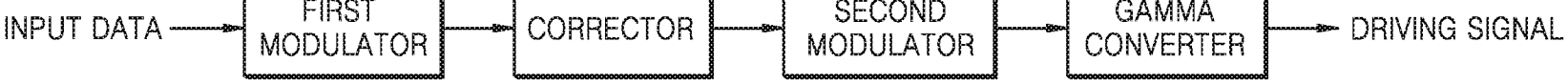
FIG. 4 is a block diagram of an internal structure of a processor of FIG. 2, according to an embodiment.

FIG. 4 is a block diagram of an internal structure of the processor 210 of FIG. 2, according to an embodiment. Referring to FIG. 4, the processor 210 may include a first modulator 211, a corrector 212, a second modulator 213, and a gamma converter 214.

When the display apparatus 200 is to represent a specific color by using a certain pixel, the display apparatus 200 may generate a digital gradation value to generate the specific color as input data Ri, Gi, Bi. For example, when the display apparatus 200 is to represent a red color by using a certain pixel, the gradation value of input data with respect to each LED included in the pixel may be 255, 0, 0. Likewise, when the display apparatus 200 is to represent a white color by using a certain pixel, the gradation value of the input data of each LED may be 255, 255, 255.

The first modulator 211 may obtain first modulation data from the input data by using a first gamma look-up table. The first gamma look-up table may function as a virtual gamma module for digital-modulating a data signal.

To reduce the amount of computation when realizing a circuit, the first gamma look-up table may be in the form of a fixed-type look-up table storing a pre-calculated gamma value which is to be applied with respect to input data. Because the standard gamma value is set as 2.2, values stored in the first gamma look-up table may include values generated by calculations performed by applying 2.2, the standard gamma value, to the input data. For example, when the input data is 0.5, the first modulator 211 may obtain a value from the first gamma look-up table, which pre-calculates and stores 0.2176, which is a value calculated from a base of 0.5 and an exponent of 2.2, and may use the obtained value as the first modulation data.

The corrector 212 may correct a color and/or a brightness by calibrating the first modulation data by applying the calibration matrix according to an embodiment to the first modulation data. The corrector 212 may minimize a difference of brightnesses and colors among pixels, in order that signals that are output from the pixels have output colors that are substantially the same as the standards of a RGB color space and are output as the standard gamma value.

According to an embodiment, when a predicted analog gamma value of a light-emitting device included in a pixel is different from the target gamma value, that is, the standard gamma value, the calibration matrix may have a compensation coefficient for compensating for the difference. According to an embodiment of the disclosure, the corrector 212 may calibrate the first modulation data by using the calibration matrix having the compensation coefficient for making change characteristics of a driving signal to be the same as characteristics according to the target gamma value.

According to an embodiment, when the predicted analog gamma value of a light-emitting device is the same as the target gamma value, there is no need to compensate for the difference, and thus, the first modulation data may be calibrated by using a basic calibration matrix. The second modulator 213 may modulate the calibrated first modulation data again by using a second gamma look-up table. The second gamma look-up table may function as a virtual gamma module for digital conversion of a data signal, in a manner similar to the first gamma look-up table. The second gamma look-up table may be a fixed-type look-up table storing a pre-calculated reciprocal gamma value applied with respect to input data. That is, values stored in the second gamma look-up table may include values obtained from calculations performed by applying 1/2.2, the reciprocal number of the standard gamma value, to the input data. The second modulator 213 may extract a resultant value corresponding to the calibrated first modulation value, by using the second gamma look-up table, and may use the extracted value as a second modulation value.

The gamma converter 214 may generate a driving signal by applying an analog gamma to the second modulation data. The analog gamma applied to the second modulation data may be a physical gamma for adjusting a signal via a voltage, rather than a virtual gamma value, like the first gamma look-up table or the second gamma look-up table. This analog gamma value may include information for having the input data generate a desired brightness.

According to an embodiment, the analog gamma value may be predetermined for each light-emitting device and may be stored in the storage 230. As described above, each light-emitting device may have different brightness characteristics, and thus, the analog gamma value of each light-emitting device may be different from the target gamma value, which is 2.2. In this case, the analog gamma values of the light-emitting devices may be different from each other.

The gamma converter 214 may obtain the analog gamma value from the storage 230 and may apply the obtained value to the second modulation data to obtain the driving signal. The driving signal may be a voltage or a current. Alternatively, according to an embodiment, rather than the driving signal obtained by the gamma converter 214, a signal corresponding to the driving signal may be applied to a certain LED of the display panel 220. The LED may emit light by being driven according to the driving signal or the signal corresponding to the driving signal. Here, the driving signal may have the same brightness change characteristics as the characteristics according to the pre-determined target gamma value.

Figure 5:
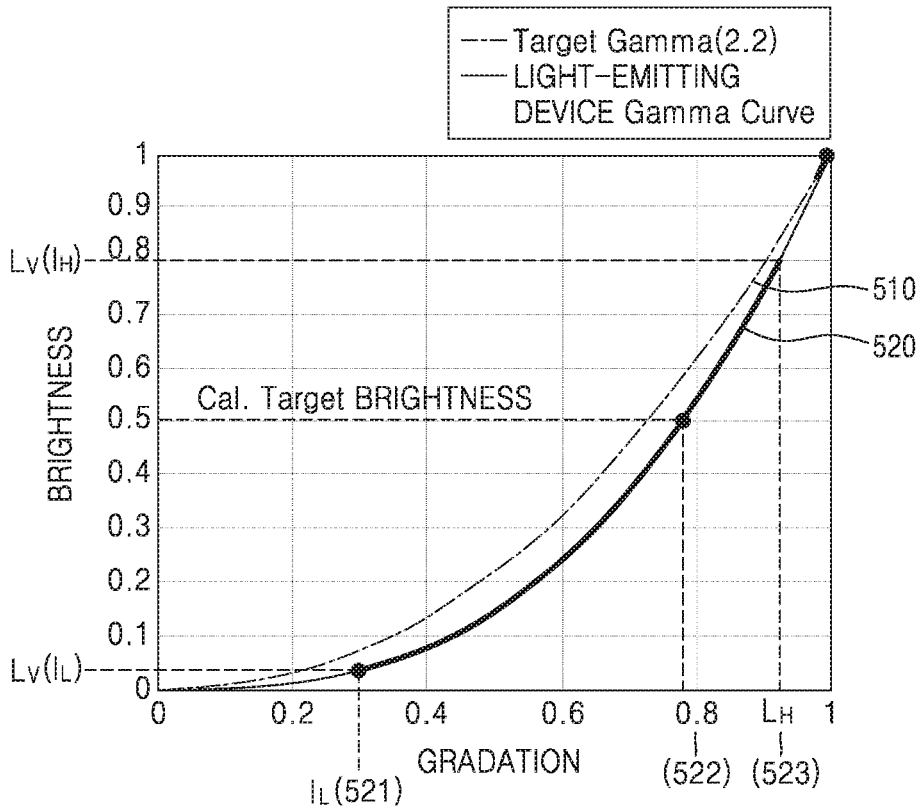
FIG. 5 shows a graph for describing a method, performed by an apparatus for generating a calibration matrix, of predicting an analog gamma value of each of light-emitting devices, according to an embodiment.

FIG. 5 shows a graph for describing a method, performed by an apparatus for generating a calibration matrix, of predicting an analog gamma value of each of light-emitting devices, according to an embodiment.

Referring to FIG. 5, a horizontal axis of the graph indicates gradation levels in which the maximum value is normalized as 1 and a vertical axis of the graph indicates brightness levels in which the maximum value is normalized as 1, wherein the brightness levels correspond to the gradation levels, respectively.

In FIG. 5, a first graph 510 illustrates a standard gamma curve in which a gamma value is 2.2, which is the standard gamma value.

According to an embodiment, the apparatus for generating the calibration matrix may measure a brightness and/or a chromaticity for each LED one or more times by using a measurer including a specific camera. The apparatus for generating the calibration matrix may predict the gamma value of each LED from a value of a signal that is output from each LED in correspondence to a gradation.

The apparatus for generating the calibration matrix may set a certain value 522 as a reference gradation and may measure a brightness in a low gradation which is less than the certain value 522 and a brightness in a high gradation which is greater than the certain value 522. The apparatus for generating the calibration matrix may predict the gamma value of each LED from brightness characteristics of the signal that is output from each LED in correspondence to the gradation.

When an input gradation of an LED is I, a brightness of a signal that is output from the LED is Lv(I), and a gamma value of the LED is r, the relationship between the input gradation and the output signal of the LED may be given as $Lv(I)=I^r$. In the graph of FIG. 5, the apparatus for generating the calibration matrix may measure a brightness Lv (IL) in a low gradation IL and a brightness Lv (IH) in a high gradation IH. The gamma value r predicted from each input gradation and the measured brightness corresponding to the gradation may be obtained as Equation 1 below.

$$r = \log_{\frac{1L}{1H}} \frac{Lv(1L)}{Lv(1H)} \quad \text{[Equation 1]}$$

The apparatus for generating the calibration matrix may generate a calibration matrix for compensating for a difference between the predicted gamma value r and the standard gamma value, by using the predicted gamma value r determined according to Equation 1 above.

The apparatus for generating the calibration matrix may store the predicted gamma value r in the storage 230. Thereafter, the processor 210 may obtain the predicted gamma value for each LED from the storage 230 and may apply the predicted gamma for each LED to the second modulation data to generate an output signal.

Figure 6:
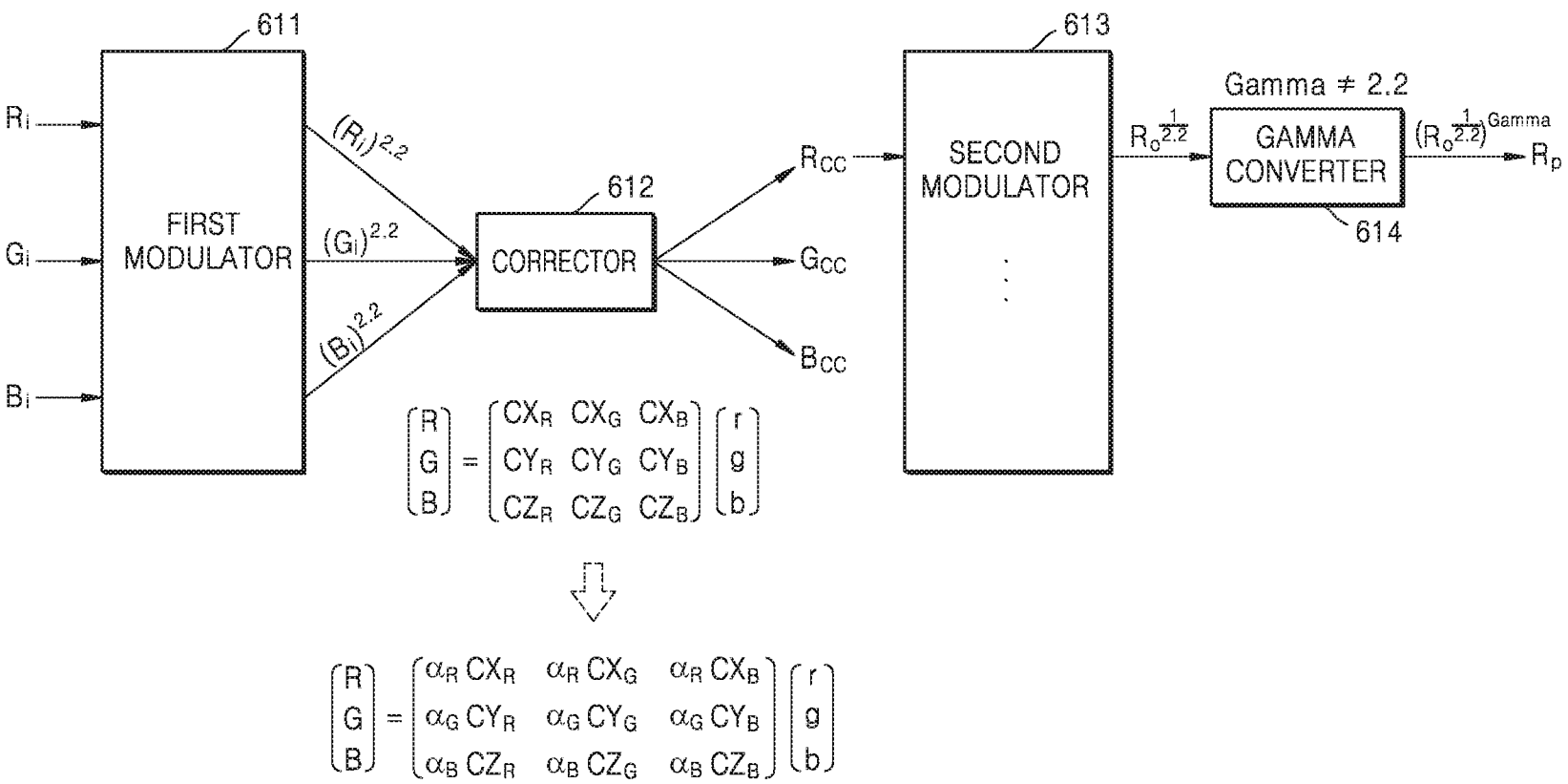
FIG. 6 is a diagram for describing a process, performed by an apparatus for generating a calibration matrix, of generating the calibration matrix, according to an embodiment.

FIG. 6 is a diagram for describing a process, performed by an apparatus for generating a calibration matrix, of generating the calibration matrix, according to an embodiment. According to an embodiment, the apparatus for generating the calibration matrix may be realized as various apparatuses, such as a personal computer, a server computer, a laptop computer, a portable electronic apparatus, etc.

The apparatus for generating the calibration matrix may use a first modulator 611, a corrector 612, a second modulator 613, and a gamma converter 614 in order to generate the calibration matrix, as shown in FIG. 6. The first modulator 611, the corrector 612, the second modulator 613, and the gamma converter 614 of FIG. 6 may perform the same functions as the components included in the processor 210 of FIG. 4. According to an embodiment, the apparatus for generating the calibration matrix may use the processor 210 of FIG. 4 to generate the calibration matrix.

The apparatus for generating the calibration matrix may predict a gamma value of each light-emitting device by measuring a brightness and/or a chromaticity of each light-emitting device, for example, as described above regarding FIG. 5. The predicted gamma value may not be the same as the standard gamma value. The apparatus for generating the calibration matrix may generate the calibration matrix for compensating for a difference between the predicted gamma value and the standard gamma value.

To this end, the apparatus for generating the calibration matrix may input a digital gradation value for generating a specific color to be represented by a certain pixel, into the first modulator 611, as an input value. The first modulator 611 may obtain first modulation data. The first modulator 611 may obtain a value obtained from calculation performed by applying a certain gamma value, that is, 2.2, to the input digital gradation value, as the first modulation data. The apparatus for generating the calibration matrix may obtain the first modulation data Ri2.2, Gi2.2, Bi2.2, in which a virtual gamma value, 2.2, is applied to input data Ri, Gi, Bi, by using the first modulator 611.

The apparatus for generating the calibration matrix may input the obtained first modulation data to the corrector 612. The corrector 612 may apply a basic calibration matrix to the first modulation data. This may be represented by Equation 2 below.

$$\begin{bmatrix} R \\ G \\ B \end{bmatrix} = \begin{bmatrix} CXR & CXG & CXB \\ CYR & CYG & CYB \\ CZR & CZG & CZB \end{bmatrix} \begin{bmatrix} r \\ g \\ b \end{bmatrix} \quad \text{[Equation 2]}$$

In Equation 2, r, g, b is data to which the basic calibration matrix is applied (i.e., the data input to the corrector 612), and R, G, B indicates values calibrated by applying the calibration matrix to the input value r, g, b (i.e., the data output by the corrector 612). In Equation 2, in the case of the basic calibration matrix, from among coefficients of the basic calibration matrix, all of CXR, CYG, CZB may become 1 and the rest may become 0.

The corrector 612 may correct a color and a brightness of the first modulation data by using the basic calibration matrix used in Equation 2 above and may output resultant corrected values Rcc, Gcc, Bcc.

The apparatus for generating the calibration matrix may input the resultant corrected values Rcc, Gcc, Bcc to the second modulator 613. The second modulator 613 may obtain second modulation data from the input values Rcc, Gcc, Bcc. The second modulator 613 may obtain a resultant value by applying 1/2.2, a reciprocal number of the gamma value, to a certain input value. For example, the second modulator 613 may output $Ro^{1/2.2}$ from the value Rcc.

The gamma converter 614 may obtain a voltage value or a current value by applying the analog gamma value to the second modulation data that is input to the gamma converter 614. As described above, the apparatus for generating the calibration matrix may measure the brightness and/or chromaticity for each light-emitting device and predict the gamma value of each light-emitting device.

The apparatus for generating the calibration matrix may use the gamma converter 614 to apply the predicted gamma value to the second modulation data. For example, the gamma converter 614 may apply a predicted gamma value r' to the second modulation data $Ro^{1/2.2}$ in order to obtain an output signal Rp with respect to a red LED. That is, the output signal Rp may be obtained as $[\{CX_R(Ri)^{2.2}+CX_G(Gi)^{2.2}+CX_B(Bi)^{2.2}\}^{1/2.2}]^{r'}$.

Preferably, in order that the gamma value used by the second modulator 613 and the analog gamma value are offset by each other, both of the gamma values used by the first modulator 611 and the second modulator 613 may have to be the same as the analog gamma value r' predicted from the actual light-emitting device. In this case, a preferable driving signal Rp' may become $[\{CX_R(Ri)^{r'}+CX_G(Gi)^{r'}+CX_B(Bi)^{r'}\}^{1/r'}]^{r'}$. Also, the preferable driving signal Rp' may become $CX_R(Ri)^{r'}+CX_G(Gi)^{r'}+CX_B(Bi)^{r'}$ because the gamma value used by the second modulator 613 and the analog gamma value are offset by each other.

In order to obtain the same result as the preferable case, the apparatus for generating the calibration matrix may add a scale value to the formula of the obtained driving signal Rp and may obtain a scale value, by which the driving signal Rp to which the scale value is added becomes the same as the preferable driving signal Rp'. That is, a compensation coefficient $\alpha_R$ may be added to the obtained driving signal Rp as in $[\{\alpha_R,CX_R(Ri)^{2.2}+\alpha_R,CX_G(Gi)^{2.2}+\alpha_R,CX_B(Bi)^{2.2}\}^{1/2.2}]^{r'}$ and the compensation coefficient $\alpha_R$ may be obtained such that the driving signal Rp to which the compensation coefficient $\alpha_R$ is added may be the same as the preferable driving signal $Rp'=CX_R(Ri)^{r'}+CX_G(Gi)^{r'}+CX_B(Bi)^{r'}$. In other words, the compensation coefficient $\alpha_R$ may be determined using the predicted gamma value r', which may be determined according to Equation 1 above using the measured brightnesses Lv (IL) in a low gradation IL and Lv (IH) in a high gradation IH.

Based on substantially the same method, the apparatus for generating the calibration matrix may obtain compensation coefficients $\alpha_G$, $\alpha_B$ from output signals with respect to a green LED and a blue LED. As a result, the calibration matrix may be generated in the form of Equation 3 below.

$$\begin{bmatrix} R \\ G \\ B \end{bmatrix} = \begin{bmatrix} \alpha R\ CXR & \alpha R\ CXG & \alpha R\ CXB \\ \alpha G\ CYR & \alpha G\ CYG & \alpha G\ CYB \\ \alpha B\ CZR & \alpha B\ CZG & \alpha B\ CZB \end{bmatrix} \begin{bmatrix} r \\ g \\ b \end{bmatrix} \quad \text{[Equation 3]}$$

In Equation 3, r, g, b is data to which to the calibration matrix is to be applied, and R, G, B indicates a value corrected by applying the calibration matrix having the compensation coefficients $\alpha_R$, $\alpha_G$, $\alpha_B$ to the data r, g, b.

Here, the compensation coefficient $\alpha_R$ may be obtained as Equation 4 below.

$$\alpha_R=\{CX_R(Ri)^{r'}+CX_G(Gi)^{r'}+CX_B(Bi)^{r'}\}^{2.2/r'}/\{CX_R(Ri)^{2.2}+CX_G(Gi)^{2.2}+CX_B(Bi)^{2.2}\} \quad \text{[Equation 4]}$$

Similarly, the apparatus for generating the calibration matrix may also obtain the compensation coefficients $\alpha_G$, $\alpha_B$.

The compensation coefficients $\alpha_R$, $\alpha_G$, $\alpha_B$ may be compensation coefficients for compensating for a difference between the predicted analog value and the standard gamma value. That is, the compensation coefficients may be values configured to make change characteristic of a driving signal to be the same as characteristics according to the predetermined standard gamma value.

The apparatus for generating the calibration matrix may obtain the analog gamma value predicted for each light-emitting device, the target gamma value, and the calibration matrix having the compensation coefficients $\alpha_R$, $\alpha_G$, $\alpha_B$ generated by using the predicted analog gamma value and the target gamma value. The apparatus for generating the calibration matrix may store the calibration matrix for each light-emitting device in the storage 230 of FIG. 2. The apparatus for generating the calibration matrix may transmit the calibration matrix to the display apparatus 200 through a communication network. Alternatively, the apparatus for generating the calibration matrix may access the display apparatus 200 so that the calibration matrix may be stored in the storage 230.

Figure 7:
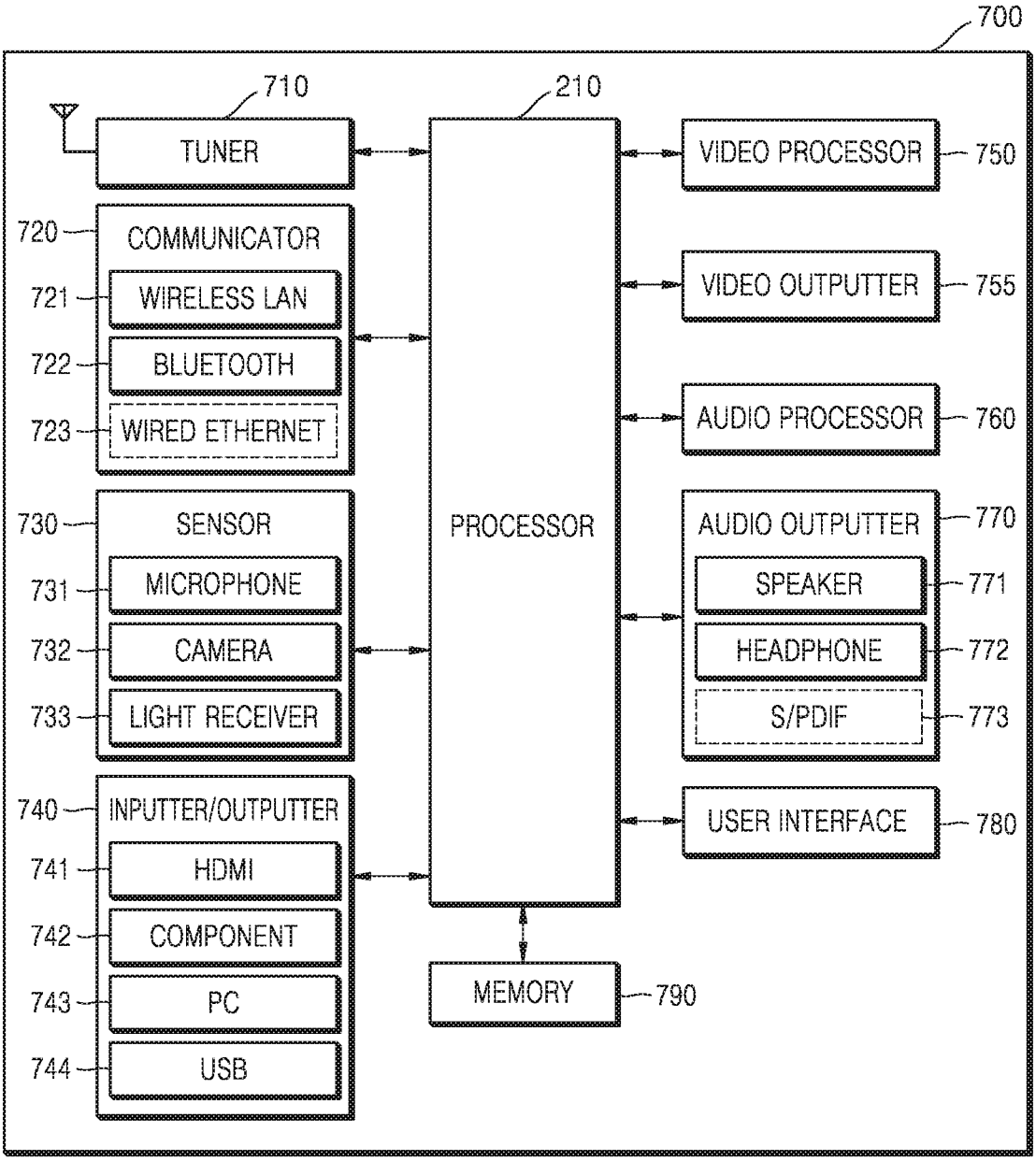
FIG. 7 is a block diagram of an internal structure of a display apparatus according to an embodiment.

FIG. 7 is a block diagram of an internal structure of a display apparatus 700 according to an embodiment of the disclosure.

Referring to FIG. 7, the display apparatus 700 may include the processor 210, the memory 790, a tuner 710, a communicator 720, a sensor 730, an inputter/outputter 740, a video processor 750, a video outputter 755, an audio processor 760, an audio outputter 770, and a user interface 780.

Aspects about the processor 210, which are the same as the aspects described with reference to FIGS. 2 and 4, will not be described.

The tuner 710 may tune and select only frequencies of a channel to be received by the display apparatus 700, from many radio components, through amplification, mixing, resonance, etc. of broadcasting content received with or without wires. The content received by the tuner 710 may be decoded (for example, audio decoding, video decoding, or additional information decoding) and separated into audio data, video data, and/or additional information. The separated audio data, video data, and/or additional information may be stored in the memory 790 under control of the processor 210.

The communicator 720 may include one or more communication modules, such as a short-range wireless communication module, a wired communication module, a mobile communication module, a broadcasting reception module, etc. Here, the one or more communication modules refer to communication modules capable of performing data transmission and reception via networks in compliance with the communication standards, such as a tuner, Bluetooth, wireless LAN (WLAN) (Wi-Fi), wireless broadband (Wibro), world interoperability for microwave access (Wimax), CDMA, and WCDMA.

The communicator 720 may connect the display apparatus 700 to an external apparatus or server under control of the processor 210. The display apparatus 700 may download, or receive, in real time, the calibration matrix having the calibration coefficients according to an embodiment from an external server or an apparatus for generating a calibration matrix, the external server or the apparatus for generating the calibration matrix being connected to the display apparatus 700 through the communicator 720. Also, the display apparatus 700 may download or receive at least one of the first gamma look-up table, the second gamma look-up table, the predicted analog gamma value, or the target gamma value according to an embodiment from the external server or the apparatus for generating the calibration matrix connected to the display apparatus 700 through the communicator 720.

Also, the display apparatus 700 may web-browse or download a program or an application required by the display apparatus 700 from an external apparatus, etc., via the communicator 720.

The communicator 720 may include one of wireless LAN 721, Bluetooth 722, and wired Ethernet 723, to correspond to the performance and the structure of the display apparatus 700. Also, the communicator 720 may include a combination of the wireless LAN 721, the Bluetooth 722, and the wired Ethernet 723. The communicator 720 may receive a control signal through a control device under control of the processor 210. The control signal may be realized as a Bluetooth type, a radio frequency (RF) signal type, or a Wi-Fi type. The communicator 720 may further include other short-range wireless communicators (for example, a near-field communicator (NFC)), or Bluetooth low energy (BLE)), in addition to the Bluetooth 722. According to an embodiment, the communicator 720 may transmit and receive connection signals to and from an external device, etc., by using short-range wireless communication methods, such as the Bluetooth 722 or the BLE.

The sensor 730 may sense a voice of a user, an image of the user, or an interaction of the user and may include a microphone 731, a camera 732, and a light receiver 733. The microphone 731 may receive an uttered voice of the user and may convert the received voice into an electrical signal and output the electrical signal through the processor 210.

The camera 732 may include an image sensor and a lens and may capture an image formed on a screen.

The light receiver 733 may receive a light signal (including a control signal). The light receiver 733 may receive the light signal corresponding to a user input (for example, a touch operation, a press operation, a touch gesture, a voice, or a motion) from a control device, such as a remote controller or a cellular phone. The control signal may be extracted from the received light signal under control of the processor 210.

The inputter/outputter 740 may receive video data (for example, a video signal or a still image signal), audio data (for example, a voice signal or a sound signal), and additional information (for example, content description, a content title, a content storage location) from a server, etc. located outside the display apparatus 700 under control of the processor 210. The inputter/outputter 740 may include one or more of a high-definition multimedia interface (HDMI) port 741, a component jack 742, a PC port 743, and a universal serial bus (USB) port 744. The inputter/outputter 740 may include a combination of the HDMI port 741, the component jack 742, the PC port 743, and the USB port 744.

The memory 790 according to an embodiment may store instructions and programs for processing and controlling operations of the processor 210. The memory 790 of FIG. 7 may perform functions corresponding to the functions of the storage 230 of FIG. 2. Thus, aspects about the memory 790 that are the same as the aspects of the storage 230 of FIG. 2 will not be described. The memory 790 may store data that is input to the display apparatus 700 or output from the display apparatus 700. Also, the memory 790 may store information or data required for an operation of the display apparatus 700.

According to an embodiment, the programs stored in the memory 790 may be classified into a plurality of modules according to functions of the programs. The memory 790 may store the different calibration matrices having different compensation coefficients for each pixel. Also, the memory 790 may store at least one of the target gamma value, the first gamma look-up table, the second gamma look-up table, the analog gamma value predicted for each light-emitting device, or the calibration matrix having the compensation coefficient each light-emitting device. The memory 790 may store programs, etc. used to apply the calibration matrix having the compensation coefficients.

The processor 210 may control general operations of the display apparatus 700 and signal flows between internal components of the display apparatus 700 and may process data. When there is a user input or when a pre-determined condition that is stored is satisfied, the processor 210 may execute an operation system (OS) and various applications stored in the memory 790.

The processor 210 according to an embodiment may execute the at least one instruction stored in the memory 790 to calibrate first modulation data obtained from input data by using the calibration matrix so that change characteristics of a driving signal may become the same as characteristics according to the target gamma value.

According to an embodiment, the processor 210 may include a plurality of processors, and in this case, a function of applying the calibration matrix having the compensation coefficients and correcting the characteristics of the driving signal may be performed by an additional processor.

Also, the processor 210 may include an internal memory. In this case, at least one of the data, the programs, or the instructions stored in the memory 790 may be stored in the internal memory of the processor 210.

The video processor 750 may process image data to be displayed by the video outputter 755 and may perform various image processing operations on image data, such as decoding, rendering, scaling, noise filtering, frame rate conversion, and resolution conversion.

The video outputter 755 may display an image signal included in content received by the tuner 710 on a screen under control of the processor 210. Also, the video outputter 755 may display content (for example, video data) that is input through the communicator 720 or the inputter/outputter 740. According to an embodiment, the video outputter 755 may output an image having a uniform brightness and a uniform color by making brightness characteristics of a driving signal to be the same as brightness characteristics according to the target gamma value, under control of the processor 210.

When the video outputter 755 is realized as a touch screen, the video outputter 755 may be used as an input device, in addition to an output device. The video outputter 755 may be realized as a panel including an LED.

The audio processor 760 may process audio data. The audio processor 760 may perform various processing operations on the audio data, such as decoding, amplification, noise filtering, etc.

The audio outputter 770 may output audio data included in content received by the tuner 710, audio data that is input through the communicator 720 or the inputter/outputter 740, or audio data stored in the memory 790, under control of the processor 210. The audio outputter 770 may include at least one of a speaker 771, a headphone output terminal 722, or a Sony/Philips digital interface (S/PDIF) output terminal 773.

The user interface 780 may denote a device used by a user to input data to control the display apparatus 700. The user interface 780 may be realized as a device for controlling the display apparatus 700, such as a key pad. When the video outputter 755 is realized as a touch screen, the user interface 780 may be replaced by a user finger or an input pen. The user interface 780 may control functions of the display apparatus 700 by using a sensor capable of recognizing motions, as well as by using a key pad, a dome switch, a jog wheel, a jog switch, a button, and a touch pad. Also, the user interface 780 may include a pointing device. For example, the user interface 780 may operate as the pointing device when a certain key input is received. For example, the sensor 730 may perform functions of the user interface 780. For example, the microphone 731 capable of receiving a voice of a user may recognize a voice command of a user as a control signal.

The user may perform environment setting of the display apparatus 700 via the user interface 780. The user may input user input information via the user interface 780. According to an embodiment, the user may use the user interface 780 to instruct the display apparatus 200 to correct the analog gamma value characteristics of the driving signal by using the calibration matrix.

The block diagrams of the display apparatuses 200 and 700 illustrated in FIGS. 2, 4, and 7 are block diagrams according to an embodiment. The components of the block diagrams may be integrated, added, or omitted according to the specification of a display apparatus actually realized. For example, two or more components may be combined into one component or one component may be divided into two or more components, according to necessity. Also, functions performed by each block are described to describe embodiments, and their detailed operations or devices do not limit the scope of the claims of the disclosure.

Figure 8:
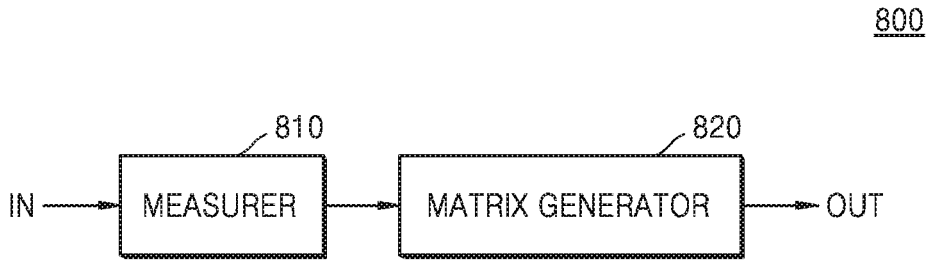
FIG. 8 is a block diagram of an internal structure of an apparatus for generating a calibration matrix, according to an embodiment.

FIG. 8 is a block diagram of an internal structure of an apparatus 800 for generating a calibration matrix according to an embodiment. Referring to FIG. 8, the apparatus 800 for generating the calibration matrix may include a measurer 810 and a calibration matrix generator 820.

The measurer 810 may capture an image of the display panel 220 by using a camera, an image sensor, etc. The measurer 810 may obtain an image of the plurality of light-emitting devices included in the display panel 220. The measurer 810 may obtain a brightness and a chromaticity for each light-emitting device from the obtained image of the light-emitting devices. The measurer 810 may measure the brightness and/or the chromaticity for each light-emitting device one or more times. To this end, the measurer 810 may measure the brightness in at least two different gradations. For example, based on a reference gradation, the measurer 810 may measure the brightness in a low gradation, which is less than the reference gradation, and the brightness in a high gradation, which is greater than the reference gradation.

The matrix generator 820 may predict a gamma value of each light-emitting device from a measured value that is output from each light-emitting device corresponding to the gradation value. The matrix generator 820 may predict an analog gamma value of each light-emitting device from the brightnesses in a plurality of gradations, for example, the low gradation and the high gradation.

The matrix generator 820 may determine whether the predicted gamma value is the same as the target gamma value. When the predicted gamma value is different from the target gamma value, the matrix generator 820 may obtain a compensation coefficient with respect to a corresponding light-emitting device and may generate the calibration matrix for a particular pixel including the light-emitting device.

The matrix generator 820 may use a digital gradation configured to generate a specific color to be represented by a certain pixel as an input value and may obtain first modulation data from the input value. Also, the matrix generator 820 may obtain second modulation data from a value generated by basically correcting a color and a brightness of the first modulation data by applying a basic calibration matrix to the first modulation data. The matrix generator 820 may obtain a voltage value or a current value by applying the predicted analog gamma value to the second modulation data.

The matrix generator 820 may obtain a compensation coefficient for making a signal value obtained by applying the predicted gamma value to the second modulation data to be the same as the target gamma value. The matrix generator 820 may generate the calibration matrix having the compensation coefficient for each light-emitting device.

According to an embodiment, when the predicted gamma value is different from the target gamma value by a value that is equal to or greater than a reference value, the apparatus 800 for generating the calibration matrix may generate the compensation coefficient by using gamma values of other adjacent light-emitting devices on a wafer on which the light-emitting device is located, rather than by using the predicted gamma value. This aspect will be described hereinafter by referring to FIG. 9.

Figure 9:
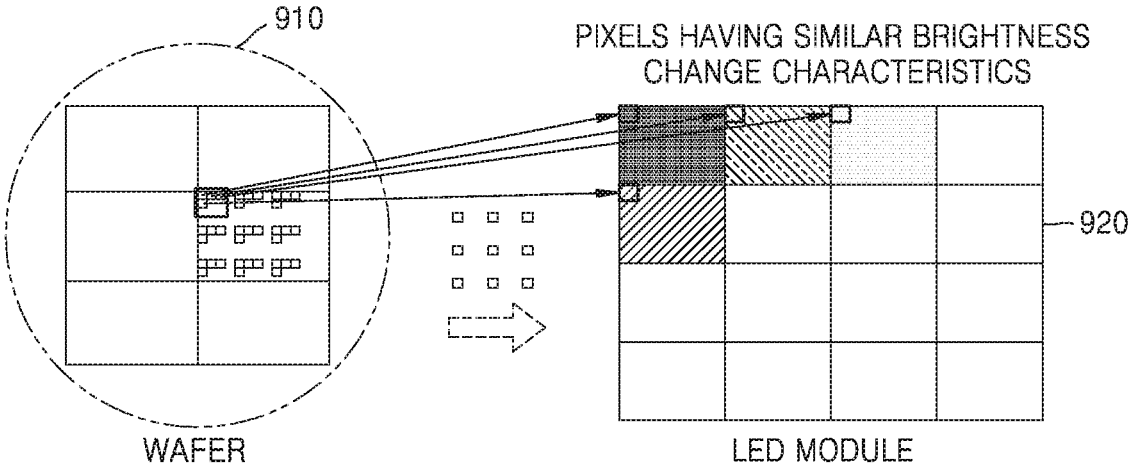
FIG. 9 is a view for describing an operation, performed by an apparatus for generating a calibration matrix, of generating the calibration matrix, according to an embodiment.

FIG. 9 is a view for describing an operation, performed by the apparatus 800 for generating the calibration matrix, of generating the calibration matrix, according to an embodiment.

Referring to FIG. 9, when generating LEDs, each LED chip formed on a wafer 910 may be captured as a stamp and transferred to an LED module 920 on a display panel.

According to an embodiment, the analog gamma value predicted for each light-emitting device may be predicted by using an output brightness measured in a plurality of gradation values for each light-emitting device. However, in some cases, there may be a significant difference between the predicted gamma value and the target gamma value.

When predicting the gamma value from the brightness of the light-emitting device, the brightness being measured by the measurer 810, and there is a difference between the predicted gamma value and the target value, the difference being greater than or equal to a certain value (i.e., a predetermined value), the measurement may be wrong. According to an embodiment, in this case, instead of predicting the gamma value of the light-emitting device by using the measured value, the gamma value may be predicted by using gamma values of light-emitting devices that were located apart from the corresponding light-emitting device by a distance that is equal to or less than a certain distance on the wafer 910 where the corresponding light-emitting device was located, wherein the corresponding light-emitting device is located on the wafer 910.

Due to distributions in processes, such as a varying temperature of the wafer 910 or an irregular thickness of the layer, chips on the wafer 910 may have different characteristics from one another. However, generally, the change characteristics of a wavelength or a brightness on the wafer 910 tend to be gradual. Thus, the gamma values measured from chips that are adjacent to each other on the wafer 910 may have similar characteristics. Thus, when the apparatus 800 for generating the calibration matrix determines that there is an error in the predicted gamma value, the apparatus 800 for generating the calibration matrix may generate the compensation coefficient by using the gamma values of other adjacent light-emitting devices on the wafer 910 on which the light-emitting device is located.

For example, the apparatus 800 for generating the calibration matrix may use an average value of the gamma values of the light-emitting devices that were located apart from the corresponding light-emitting device by a distance equal to or less than a certain distance (i.e., a predetermined distance), or may use the gamma values of the adjacent light-emitting devices instead of the gamma value of the corresponding light-emitting device by applying a weight according to the distance by which the adjacent light-emitting devices are spaced apart from the corresponding light-emitting device.

The apparatus 800 for generating the calibration matrix may generate the compensation coefficient by using the average predicted gamma value of the other adjacent light-emitting devices on the wafer on which the light-emitting device is located, rather than by using the predicted gamma value. The apparatus 800 for generating the calibration matrix may generate the calibration matrix having the compensation coefficient and transmit the calibration matrix to the display apparatus 200.

Figure 10:
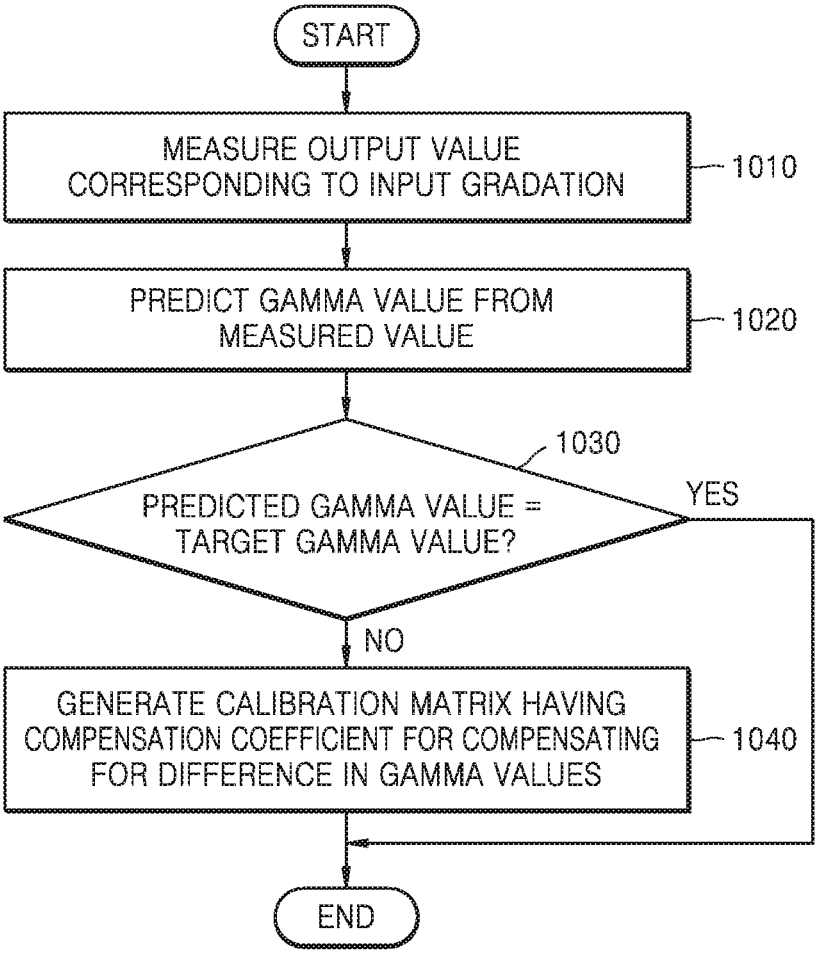
FIG. 10 is a flowchart of a method of generating a calibration matrix, according to an embodiment.

FIG. 10 is a flowchart of a method of generating a calibration matrix, according to an embodiment.

Referring to FIG. 10, the apparatus 800 for generating the calibration matrix may measure an output value that is output in correspondence to an input gradation, for each light-emitting device, by using a measurer, etc. (operation 1010).

The apparatus 800 for generating the calibration matrix may measure a brightness and/or a chromaticity for each light-emitting device one or more times. For example, based on a certain reference gradation, the apparatus 800 for generating the calibration matrix may measure the brightness in a low gradation, which is less than the reference gradation, and the brightness in a high gradation, which is greater than the reference gradation.

The apparatus 800 for generating the calibration matrix may predict an analog gamma value of the corresponding light-emitting device from the measured value (operation 1020). The apparatus 800 for generating the calibration matrix may predict the analog gamma value of the corresponding light-emitting device from the brightnesses corresponding to the low gradation and the high gradation.

The apparatus 800 for generating the calibration matrix may determine whether the predicted gamma value is the same as a target gamma value (operation 1030). The target gamma value may be the same as the standard gamma value, 2.2.

When the predicted gamma value is different from the target gamma value, the apparatus 800 for generating the calibration matrix may generate a calibration matrix having a compensation coefficient with respect to the corresponding light-emitting device for a pixel including the corresponding light-emitting device (operation 1040).

In order to generate the calibration matrix, the apparatus 800 for generating the calibration matrix may use a digital gradation for generating a specific color to be represented by a certain pixel as an input value and obtain first modulation data from the input value. The apparatus 800 for generating the calibration matrix may correct a color and a brightness of the first modulation data by using a basic calibration matrix for the first modulation data and may obtain second modulation data from a resultant corrected value.

The apparatus 800 for generating the calibration matrix may obtain a corresponding voltage or current value by applying the predicted analog gamma value above to the second modulation data. The apparatus 800 for generating the calibration matrix may obtain the compensation coefficient such that a signal value obtained by applying the predicted gamma value to the second modulation data becomes the same as a preferable driving signal, that is, a driving signal obtained when the analog gamma value is the same as the target gamma value. The compensation coefficient may be configured to compensate for a difference between the predicted analog value and the standard gamma value. The apparatus 800 for generating the calibration matrix may generate the calibration matrix having the compensation coefficient for each light-emitting device.

When the predicted gamma value is the same as the target gamma value, the apparatus 800 for generating the calibration matrix may not additionally generate the calibration matrix for pixels including the corresponding light-emitting device. In this case, the display apparatus 200 may calibrate the first modulation data by using the basic calibration matrix in which the appropriate coefficients are set to 1.

Figure 11:
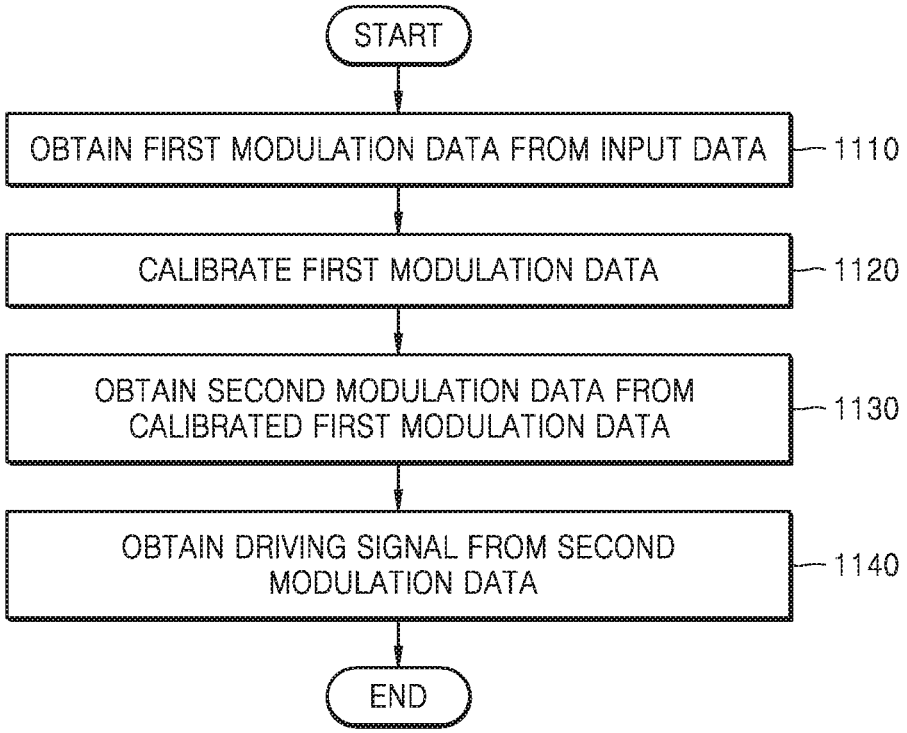
FIG. 11 is a flowchart of a method of adjusting a driving signal by using a calibration matrix, according to an embodiment.

FIG. 11 is a flowchart of a method of adjusting a driving signal by using a calibration matrix, according to an embodiment.

Referring to FIG. 11, the display apparatus 200 may generate a gradation value of a color to be represented by a certain LED as input data. The display apparatus 200 may obtain first modulation data from the input data (operation 1110). To this end, the display apparatus 200 may obtain the first modulation data corresponding to the input data by using a first gamma look-up table.

The display apparatus 200 may calibrate the first modulation data (operation 1120). The display apparatus 200 may correct a color and/or a brightness by calibrating the first modulation data by applying the calibration matrix according to an embodiment to the first modulation data. According to an embodiment, when a predicted analog gamma value of a light-emitting device is different from a target gamma value, that is, the standard gamma value, the calibration matrix may include the compensation coefficient for compensating for the difference in gamma values. According to an embodiment, when the predicted analog gamma value of the light-emitting device is the same as the target gamma value, the calibration matrix having the compensation coefficient of 1 is applied to the first modulation data.

The display apparatus 200 may obtain second modulation data from the calibrated first modulation data (operation 1130). The display apparatus 200 may extract a resultant value corresponding to the calibrated first modulation value by using a second gamma look-up table, and may use the extracted value as a second modulation value.

The display apparatus 200 may obtain a driving signal from the second modulation data (operation 1140). The display apparatus 200 may generate the driving signal by applying the analog gamma to the second modulation data. The analog gamma value may be predicted for each light-emitting device. The generated driving signal may be a voltage or a current and may have brightness change characteristics that are the same as characteristics according to the predetermined target gamma value.

The display apparatus and the operating method thereof according to the one or more of the embodiments disclosure may also be implemented with a recording medium including computer-executable instructions, such as a program module executed in computers. Computer-readable media may be arbitrary media which may be accessed by computers and may include volatile and non-volatile media, and detachable and non-detachable media. Also, the computer-readable media may include computer storage media and communication media. The computer storage media include all of volatile and non-volatile media, and detachable and non-detachable media which are designed as methods or techniques to store information including computer-readable instructions, data structures, program modules, or other data. The communication media include transmission mechanisms or other data of modulated data signals, such as computer-readable instructions, data structures, and program modules. Also, the communication media include other information transmission media.

Also, in this specification, a "unit" may refer to a hardware component, such as a processor or a circuit, and/or a software component executed by a hardware component such as a processor.

Also, the display apparatus and the operating method thereof according to the one or more of the embodiments may be realized as a computer program product including a recording medium having stored thereon a program for executing operations including: calibrating first modulation data obtained from input data of a light-emitting device; obtaining second modulation data from the calibrated first modulation data; generating a driving signal from the second modulation data; and driving a display panel by applying the driving signal to the light-emitting device, wherein the calibrating of the first modulation data includes calibrating the first modulation data by using a calibration matrix having a compensation coefficient configured to make change characteristics of the driving signal to be the same as characteristics according to a pre-determined target gamma value.

The display apparatus and the operating method thereof according to the one or more of the embodiments of the disclosure may predict a gamma value of a light-emitting device by measuring an output brightness value of the light-emitting device corresponding to an input gradation of the light-emitting device.

The display apparatus and the operating method thereof according to the one or more of the embodiments of the disclosure may make change characteristics of an output signal to be the same as characteristics according to a target gamma value, by using a calibration matrix having a compensation coefficient configured to compensate for a difference between a predicted gamma value of a light-emitting device and the target gamma value.

While the disclosure has been particularly shown and described with reference to example embodiments, it will be understood by one of ordinary skill in the art that various changes in form and details may be made therein without departing from the spirit and scope of the disclosure as defined by the following claims. Hence, it will be understood that the embodiments of the disclosure described above are examples in all aspects and are not limiting of the scope of the disclosure. For example, each of components described as a single unit may be executed in a distributed fashion, and likewise, components described as being distributed may be executed in a combined fashion.

What is claimed is:

1. A display apparatus comprising:

a display panel comprising a light-emitting device;

a storage storing a target gamma value and a calibration matrix;

a processor configured to obtain first modulation data from input data by applying a gamma value to the input data, calibrate the first modulation data via the calibration matrix, obtain second modulation data from the calibrated first modulation data by applying a reciprocal of the gamma value to the calibrated first modulation data, and generate a driving signal from the second modulation data; and a panel driver configured to drive the display panel by applying the driving signal to the light-emitting device, wherein the calibration matrix comprises a compensation coefficient for making a gamma curve corresponding to the driving signal to be the same as a target gamma curve corresponding to the target gamma value.

2. The display apparatus of claim 1, wherein the storage stores a respective calibration matrix for each pixel including the light-emitting device, and wherein the processor is further configured to calibrate the first modulation data by using the respective calibration matrix for each pixel.

3. The display apparatus of claim 1, wherein the storage stores a first gamma look-up table and a second gamma look-up table, and wherein the processor is further configured to obtain the first modulation data from the input data according to the first gamma look-up table and obtain the second modulation data from the calibrated first modulation data according to the second gamma look-up table.

4. The display apparatus of claim 3, wherein the first gamma look-up table comprises a first value calculated by applying a standard gamma value to a first input value, and the second gamma look-up table comprises a second value calculated by applying a reciprocal number of the standard gamma value to a second input value.

5. The display apparatus of claim 1, wherein, when the gamma curve corresponding to the driving signal is the same as the target gamma curve corresponding to the target gamma value, the compensation coefficient has a value of 1.

6. An apparatus for generating a calibration matrix, the apparatus comprising:

a measurer configured to measure an output value of a light-emitting device; and a matrix generator configured to predict a gamma value of the light-emitting device from the measured output value, generate a compensation coefficient for compensating for a difference between the predicted gamma value and a target gamma value, and generate the calibration matrix from the compensation coefficient.

7. The apparatus of claim 6, wherein, when the difference between the predicted gamma value and the target gamma value is greater than or equal to a reference value, the matrix generator is further configured to predict an average gamma value of a plurality of other light-emitting devices which were located apart from the light-emitting device by a distance that is less than or equal to a predetermined distance on a wafer where the light-emitting device was located, generate a second compensation coefficient for compensating for the difference between the predicted average gamma value and the target gamma value, and generate the calibration matrix from the second compensation coefficient.

8. The apparatus of claim 7, wherein the matrix generator is further configured to predict the gamma value from two or more output values measured in response to two or more input gradations applied as input signals to the light-emitting device.

9. The apparatus of claim 8, wherein the two or more input gradations comprise a low gradation less than a predetermined gradation and a high gradation greater than the predetermined gradation.

10. The apparatus of claim 6, wherein the matrix generator is configured to predict the gamma value of the light-emitting device from a first measured output value corresponding to a first gradation above a reference gradation and from a second measured output value corresponding to a second gradation below the reference gradation.

11. A display method comprising:

obtaining first modulation data from input data of a light-emitting device by applying a gamma value to the input data;

calibrating the first modulation data;

obtaining second modulation data from the calibrated first modulation data by applying a reciprocal of the gamma value to the calibrated first modulation data;

generating a driving signal from the second modulation data; and driving a display panel by applying the driving signal to the light-emitting device, wherein the calibrating of the first modulation data comprises calibrating the first modulation data by using a calibration matrix comprising a compensation coefficient for making a gamma curve corresponding to the driving signal to be the same as a target gamma curve corresponding to a target gamma value.

12. The display method of claim 11, wherein the calibrating of the first modulation data comprises calibrating the first modulation data by using a respective calibration matrix for each pixel including the light-emitting device.

13. The display method of claim 11, wherein the first modulation data is obtained by modulating the input data according to a first gamma look-up table, and the second modulation data is obtained by modulating the calibrated first modulation data according to a second gamma look-up table.

14. The display method of claim 13, wherein the first gamma look-up table comprises a first value calculated by applying a standard gamma value to a first input value, and the second gamma look-up table comprises a value calculated by applying a reciprocal number of the standard gamma value to an input value.

15. The display method of claim 11, wherein, when the gamma curve corresponding to the driving signal is the same as the target gamma curve corresponding to the target gamma value, the compensation coefficient has a value of 1.

16. A method of generating a calibration matrix, the method comprising:

measuring an output value corresponding to an input gradation of a light-emitting device;

predicting a gamma value of the light-emitting device from the measured output value;

obtaining a compensation coefficient for compensating for a difference between the predicted gamma value and a target gamma value; and generating the calibration matrix from the compensation coefficient.

17. The method of claim 16, further comprising:

when the difference between the predicted gamma value and the target gamma value is greater than or equal to a reference value, predicting an average gamma value of a plurality of other light-emitting devices which were located apart from the light-emitting device by a distance that is less than or equal to a predetermined distance on a wafer where the light-emitting device was located; and generating a second calibration matrix comprising a second compensation coefficient for compensating for the difference between the predicted average gamma value and the target gamma value, by using the predicted average gamma value rather than the predicted gamma value.

18. The method of claim 16, wherein the measuring of the output value comprises measuring at least two output values corresponding to at least two input gradations, and the predicting of the gamma value comprises predicting the gamma value from the at least two output values measured in correspondence to the at least two input gradations.

19. A non-transitory computer-readable recording medium having recorded thereon a program for executing a display method on a computer, the display method comprising:

obtaining first modulation data from input data of a light-emitting device by applying a gamma value to the input data;

calibrating the first modulation data;

obtaining second modulation data from the calibrated first modulation data by applying a reciprocal of the gamma value to the calibrated first modulation data;

generating a driving signal from the second modulation data; and driving a display panel by applying the driving signal to the light-emitting device, wherein the calibrating of the first modulation data comprises calibrating the first modulation data by using a calibration matrix comprising a calibration coefficient for making a gamma curve corresponding to the driving signal to be the same as a target gamma curve corresponding to a target gamma value.

* * * * *